US006301808B1

(12) United States Patent
Hodge

(10) Patent No.: US 6,301,808 B1
(45) Date of Patent: Oct. 16, 2001

(54) EARTH MOVING EQUIPMENT

(76) Inventor: John Raymond Hodge, RMB 2855, Numurkah, Victoria 3636 (AU)

( * ) Notice: Subject to any disclaimer, the term of this patent is extended or adjusted under 35 U.S.C. 154(b) by 0 days.

(21) Appl. No.: 09/434,960

(22) Filed: Nov. 5, 1999

(30) Foreign Application Priority Data

Nov. 6, 1998 (AU) ..... PP 6940

(51) Int. Cl.[7] ..... E02F 3/64
(52) U.S. Cl. ..... 37/428; 37/416
(58) Field of Search ..... 172/684.5, 799.5; 37/416, 341, 411, 417, 419, 425, 428

(56) References Cited

U.S. PATENT DOCUMENTS

| | | | | |
|---|---|---|---|---|
| 3,646,693 | * | 3/1972 | Simmons | 37/8 |
| 4,393,608 | * | 7/1983 | Hodge | 37/124 |
| 5,356,238 | * | 10/1994 | Musil et al. | 404/84.1 |
| 5,824,541 | * | 10/1998 | Horn et al. | 435/262.5 |
| 5,839,212 | * | 11/1998 | Brinker | 37/416 |
| 6,041,528 | * | 3/2000 | Broach | 37/431 |

* cited by examiner

*Primary Examiner*—Robert E. Pezzuto
(74) *Attorney, Agent, or Firm*—Edwin D. Schindler

(57) ABSTRACT

An earth moving and land grading machine includes a frame and road wheels mounted on the frame, with a forwardly directed device for permitting connection to a prime mover. The frame has a bin for receiving material. A rear wall is movable between a first position, in which the bin is substantially open for receiving material therein, to a second, forward position during movement for delivering the material from the bin. Movement of the rear wall between the first position and the second, forward position is via a hydraulic ram having a piston. The piston has an outer end that moves along a fixed path and is pivotally connected to an arm partway along a length thereof, so that portions of the arm on each side of the pivotable connection have unequal lengths. A first length of the unequal arm lengths has a longer length and is connected to the rear wall and the second length of the unequal arm lengths has a shorter length and is connected to the earth moving and land grading machine. Upon movement of the hydraulic ram in a first direction, the rear wall moves rearwardly and upon movement of the hydraulic ram in a second direction, the rear wall moves forwardly, with movement in the first direction and the second direction being by a distance greater than the movement of the piston of the hydraulic ram.

22 Claims, 8 Drawing Sheets

Ground Line
63
50
64
60
65
36
43
61
66
67
70
40
71
72
41
32
42
31

EARTH MOVING EQUIPMENT

BACKGROUND OF THE INVENTION

Technical Field of the Invention

This invention relates to earth moving equipment and in particular to an improved earth moving and land grading machines.

DESCRIPTION OF THE PRIOR ART

There have been proposed a number of different forms of such machine one of which is illustrated in applicant's prior Australian Patent No. 552006 dated Sep. 1, 1981 and the contents of the specification of the Patent are to be deemed to be incorporated herein as an example of the prior art.

The previously known equipment has been satisfactory in use and there are many machines both of the type disclosed in applicant's previous Patent and of other types which have been in substantial use over the last ten to fifteen years.

The machines, whilst satisfactory, do have certain disadvantages.

The first is in overall load capacity. This is determined largely, of course, by the size of the machine itself and the power of the tractor as the material being passed into the machine tends to bank up in the machine to cause an obstruction to move material entering and, further, as the road wheels of such devices are normally close to the back there can be a strong turning moment about the tractor draw bar and this, again, limits the carrying capacity.

These machines are often provided with rippers across the width of the machine and, forwardly, in the direction of movement of the bin or container. We have found in some applications that these cause very large pieces of soil to be lifted and this is not greatly satisfactory when it is to be later unloaded from the machine and, secondly, the fact that the rippers are across the width of the machine it necessitates a substantial amount of power for these to be forced to move through the ground.

SUMMARY OF THE INVENTION

The principal object of the invention is to provide earth moving equipment which minimizes the afore said difficulties.

The invention, in a first aspect, comprises an earth moving and land grading machine comprising a frame, road wheels on the frame and forwardly directed means to permit connection to a prime mover, the frame having associated therewith a bin or container for material characterized in that the rear wall of the bin is moveable between a first position, where the bin is effectively open and can receive soil therein, to a forward position during movement to which it can deliver the soil from the bin, characterised in that, the movement is by a hydraulic ram which is adapted to provide a mechanical advantage so that the wall moves forward a distance substantially greater than the equivalent extension of the ram.

In a first aspect the outer end of the piston of the ram is caused to move along a fixed path and is pivotally connected to an arm partway along the arm so that the portions of the arm on each side of the pivot have unequal lengths, the end associated with the longer length being connected to the wall and the other, associated with the shorter length being connected to the machine, the arrangement being such that on movement of the ram the wall is caused to move a distance greater than the movement of the piston of the ram.

In a second aspect of the invention the floor of the bin is of two parts, one of which is fixed and covers the forward end of the floor of the bin, and the other, which is moveable and adapted to move between a position where it is effectively behind the first part to provide a floor for the whole of the machine to a position where it substantially overlays the first part and terminates close to the front of the first part.

It is preferred that the wall is associated with the second part so that when the second part is behind the first part the wall is connected thereto, means being provided to release the connection of the wall when the second part overlies the first part so that the wall can be moved forwardly over the second part.

It is also preferred that when the second part of the floor is forwardly positioned, it is latched so as to be unable to move relative to the first part of the floor whilst the wall moves thereover, the latch being released when the wall reaches the rear thereof at which time the second part is re-connected to the wall to move rearwardly therewith.

This arrangement means that frictional resistance in respect of the earth entering the bin is substantially reduced. Delivery of material from the bin occurs in the opposite movement.

In a third aspect of the invention the road wheels are on each side of the machine and each side is provided with a pair of beams which are pivotally mounted, there being at least two wheels on each beam, the wheels of one of the beams are transversely further out from the body of the unit than the others, and the wheels on each beam being spaced differently in a longitudinal direction and are so arranged that they partially overlap so that build up of soil or mud on the wheels is prevented because of the close relationship between the wheels the wheels of the device are on each side of the device and on each side are provided on a pair of beams which are pivotally mounted, there being at least two wheels on each beam and the wheels of one of the beams are transversely further out from the body of the unit than the others, and the wheels are so arranged that they closely overlap so that build up of soil or mud on the wheels is prevented because of the frictional contact of the adjacent wheels.

BRIEF DESCRIPTION OF THE DRAWING FIGURES

In order that the invention may be more readily understood, I shall describe one embodiment of the invention in relation to the accompanying drawings, in which.

DETAILED DESCRIPTION OF THE DRAWING AND PREFERRED EMBODIMENTS

Figure 1:
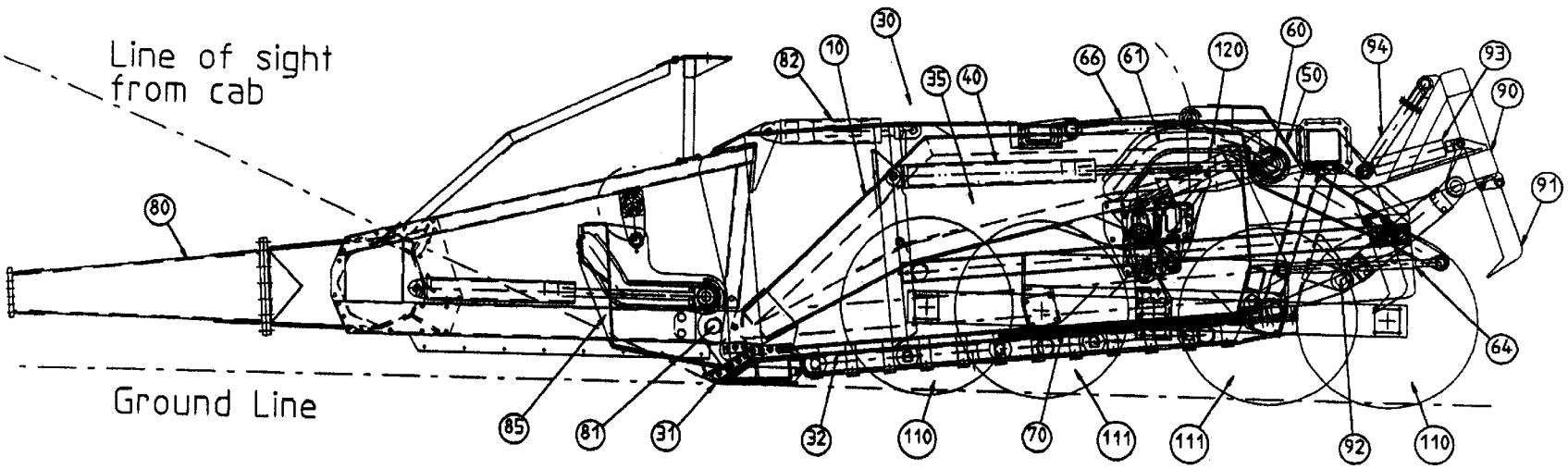
FIG. 1 shows a side elevation of the machine.

The illustrated machine can have a tare of 12 tonne and can be adapted to carry a load of 20 tonne giving a gross weight of 32 tonne. The machine has a frame 10 which needs to be of substantial strength as it can carry this weight and the frame is provided with road wheels 20 adjacent each side thereof.

The particular construction of the road wheels will be discussed further hereinafter.

Mounted on the frame there is a bin or container 30 to receive soil and the like which has a forward lip 31 which is adapted to pass into the surface of the ground and to cause the material passing thereover to be loaded into the bin 30.

On the forward end of the frame there may be a substantially A-shaped draw bar construction 80 which can be connected to the frame by a transverse pivot and which draw bar is adapted for connection at its forward end to a prime mover or the like (not shown).

The various configurations of the components, one relative to the other, can be varied to provide the required operating parameters and will not generally be described unless they are relevant to the various features of the particular construction which incorporate the novel aspects of the invention.

Filling the bin with material

When the bin is to be filled with material, the moveable wall 36 is located to the front of the floor. The bin can be partially rotated about pivot 81 by ram 82 so the lip 31 at the front of the bin can enter the ground by a required distance. As the machine is moved forwardly, material will be lifted by the lip and fed into the bin and this causes the moveable wall to move rearwardly under the pressure of the material. The full operation of the wall and, where provided, the split floor, will be described hereinafter.

It can be seen that when the machine is being filled, the general slope of the machine is downwardly toward the front. When the machine is being towed, this slope is reduced.

Delivery of material from the bin

The bin has a floor 32 which has the forward lip 31, previously discussed, two side walls 35 and a rear wall 36 which is moveable relative to the floor and side walls, to effect delivery of material from the bin.

This movement is effected by a pair of hydraulic rams 40, one of which can be located on each side of the bin, on the exterior surface thereof. The rams 40 are pivotally connected at 41 to the frame or the side wall of the bin by way of a bracket 42.

The pistons 43 of the rams 40 are connected to a bell crank like member 50 part way along the length thereof and co-axial at the point of connection there is a roller 60 which is constrained to move along a cut out slot 61 in or associated with the side 35 of the bin.

The two rollers 60 are connected across the width of the machine behind the rear wall by member 62 so that movement of the rear wall, as will be described later herein is maintained parallel, regardless of the loading applied to this.

The arrangement of the bell crank like arm 50 will be described further hereinafter is adapted to provide a mechanical advantage so that relatively small movements of the piston 43 can be reflected in relatively large movements of one end 63 of the member 50 which, in turn, is connected by link 64 to the moveable rear wall 36.

The other, shorter end of the member 50 is pivotally connected at 65 to a rod 66 which can extend forwardly and be pivotally connected at 67 to the side wall or some point of connection adjacent this.

In general terms the arrangement is such that when the pistons 43 are moved outwardly from the ram 40, the bell-crank like member 50 is effectively caused to move along the slot 61 and because of the location of the links 64 and 66 to rotate about the pivot of the rollers 60. There are thus two types of movement applied to ho end 63 of the bell crank 50 which is connected by link 64 to the rear wall 36 of the bin, a translational movement due to the physical shifting of the rollers 60 along the slots and a rotational movement of the bell crank member under control of the links. The combination of these causes movement of the rear wall 36 by a distance substantially greater than could readily be achieved by the provision of a ram or rams alone.

As discussed there is one of these assemblies on each side of the bin and these are interconnected by the member 62 so that the movement of the rear wall is maintained parallel to its initial position and it moves forwardly in this way regardless of any asymmetric load against the rear wall. Such loads are, of course, not unusual as the bin will not normally be filled in a completely uniform manner.

As illustrated, the rams 40 are arranged so that, when material is to be fed into the bin, the wall is initially caused to move rearwardly by operation of the ram in the sense opposite to that described above to permit ready ingress of material.

The arrangement enables me to use a piston having a cylinder length very much less than the total distance of movement required on the rear wall and, in fact, this can be of the order of one third of the required distance without causing any mechanical difficulties from the load point of view.

Two piece floor

Figure 4:
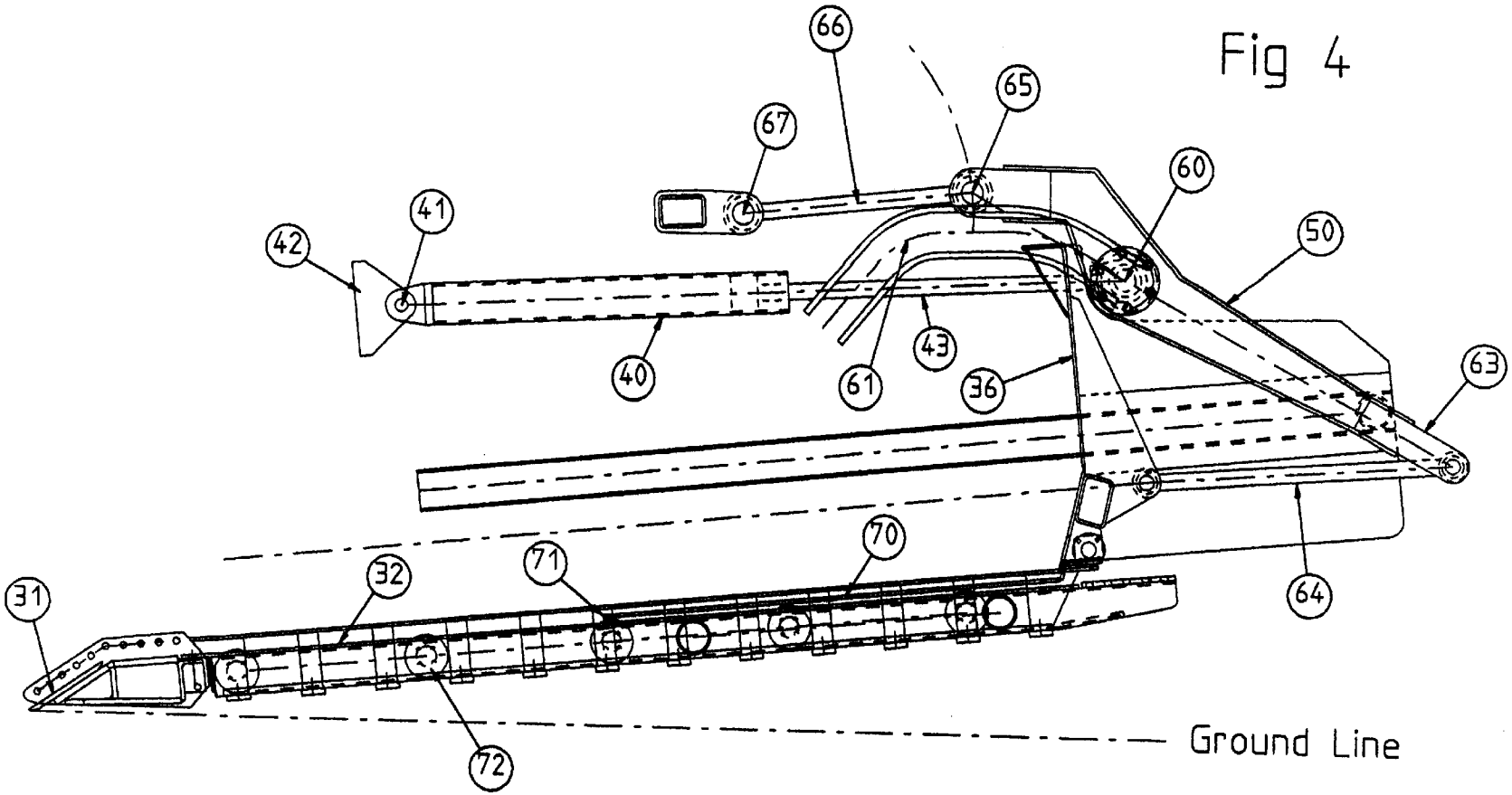
FIG. 4 shows the arrangement of the moveable floor and its mechanism with the floor fully retracted.
Figure 5:
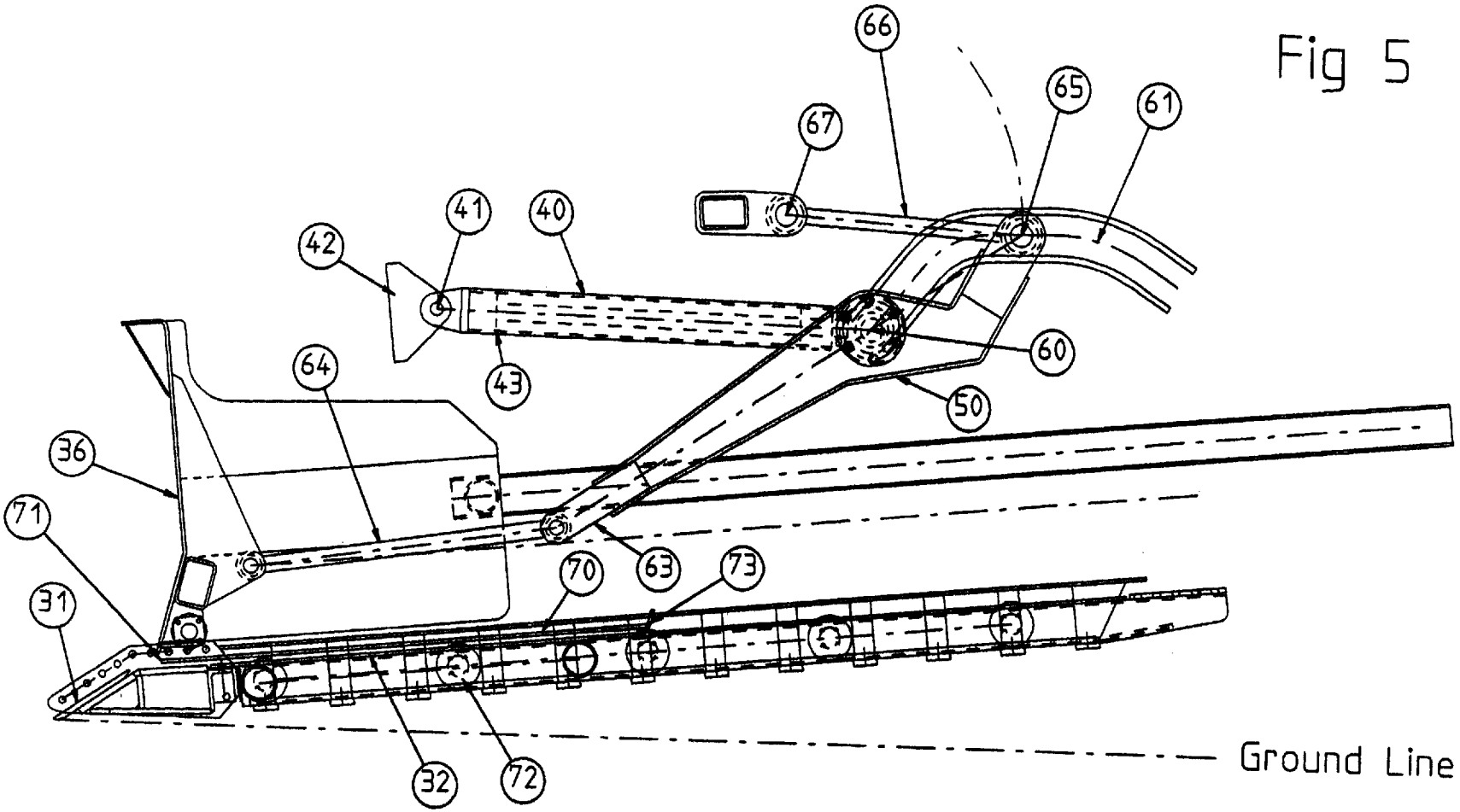
FIG. 5 is a view similar to FIG. 4 with the floor fully forward.
Figure 6:
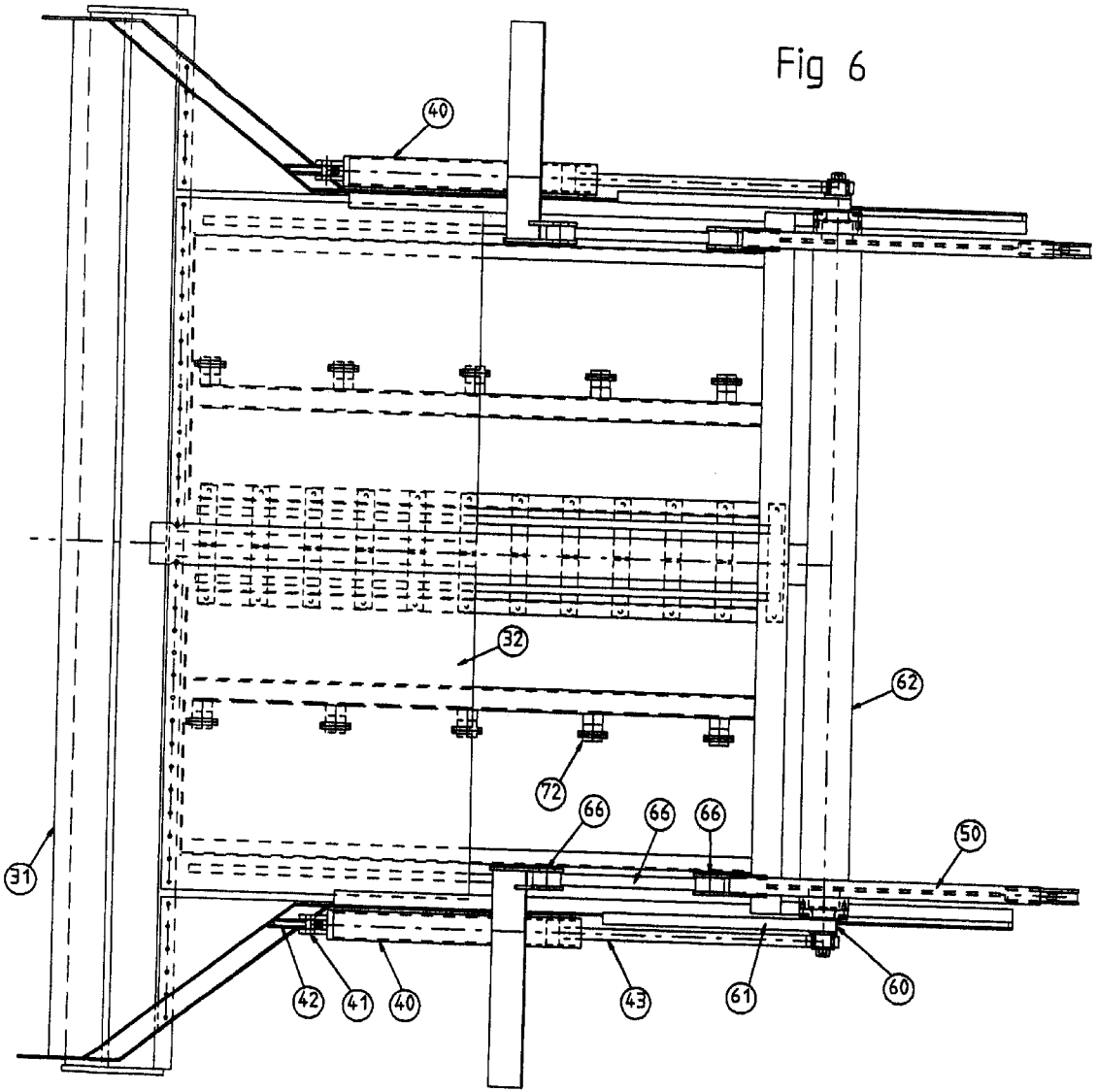
FIG. 6 is a plan view similar to FIG. 2 showing the arrangement of the bin and the moveable floor.
Figure 7:
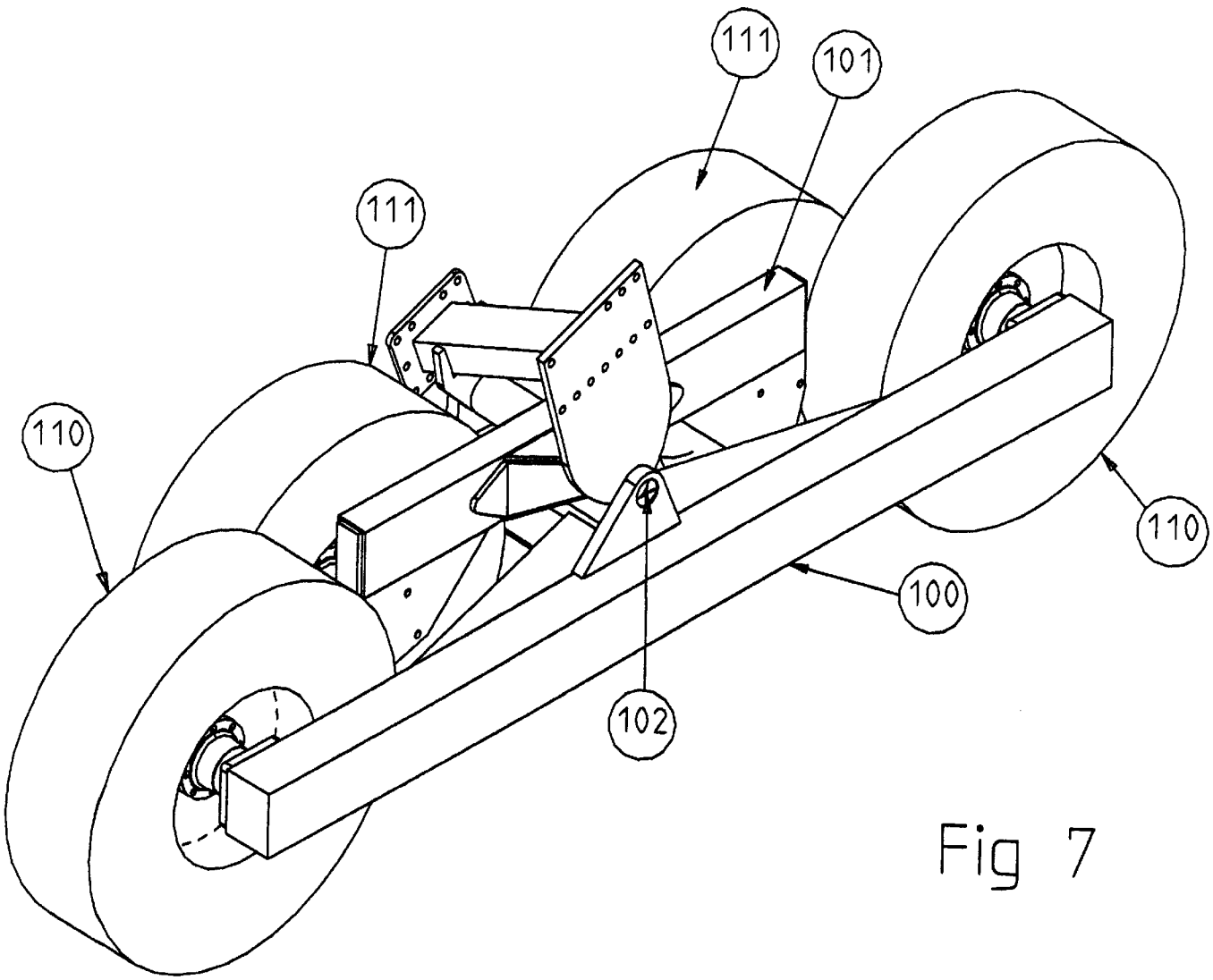
FIG. 7 is perspective view of the road wheels on one side of the machine; and, FIG. 8 is a plan view of the wheels of FIG. 7.

This is as illustrated, and is most desirable where the bin is to carry large quantities of earth. The bin floor can be constituted of two members a first, fixed, part 32 which is extends over the front portion of the bin and a second, moveable, part 70 which is connected the moveable rear wall 36 when it is in its rearmost position and to the fixed part 32 when in its forward position as will be described herein. This second part which may, for exemplification, be of a size to occupy approximately half the length of the bin. This second part is moveable from a position as shown in FIG. 4 where the wall 36 is in its rearmost position and its forward end 71 terminates part way along the length of the member 32 to a position, illustrated in FIG. 5, where its forward end terminates close to the front of the first member 32.

The arrangement is that when the second part 70 is in its rearmost position, it is connected to the movable wall 36 and when the rear wall 36 initially moves forwardly, delivering material in the bin to the front of the machine, the second part of the floor is connected to and moves with the wall. When the second part reaches its forward position, where it effectively overlies the first part 32, the connection with the wall 36 is released and the second part 70 is latched to the first part 32. The moveable wall 36 can then move forwardly over the second part 70 until it is located adjacent the lip 31 at the front of the machine and the material has been delivered.

In this arrangement when the bin is to be loaded the second floor part is left in its forward position and the wall is moved rearwardly by the rams 40 to it intermediate position where it is at the rear of the second wall part, and it may be connected thereto. Material is permitted to enter the bin until it effectively fills the exposed part of the bin, that is the part defined by the side walls, the second floor part and the rear wall. When this filling has been completed, the rear wall and the second floor part are connected, if they have not previously been connected and are caused, by rams 40 to move to their rearmost position and further material is fed onto the part of the bin now exposed, that is the part defined by the side walls, the front of the material already in the bin and the front of the bin, thereby filling the bin.

In order to facilitate the movement of the second floor part relative to the first floor part 32, I provide rollers 72 to support the member 70, the rollers being spaced from each side thereof and may extend through apertures in the floor member 32. I may also provide rollers along each side thereof.

It is preferred that I provide a front closure member or apron 85 which may preferably be arcuate and which can move downwardly over and in front of the front of the bin causing soil build up at the front of the bin to be drawn back into the bin and ensure that the material in the bin is retained therein whilst the machine moves.

When the bin is to be emptied then the procedure is directly reversed, that is the door, if any, opens, the rear wall 36 together with the second floor part 70 is caused to move forwardly on extension of the rams 40 causing the previously described complex movement of the bell-crank like members 50 and this movement causes delivery of the earth from the first floor member until the second floor member has reached close to the front of the first floor member at which time it is latched relative thereto and stops moving and the rear wall is caused to continue to move forwardly to complete the delivery of the contents of the bin.

I prefer to provide on each side of the machine a pair of beams 100 and 101 which can be pivotally mounted about pivot 102 effectively centrally, the pivot having an axis transverse to the direction of movement of the machine.

Figure 8:
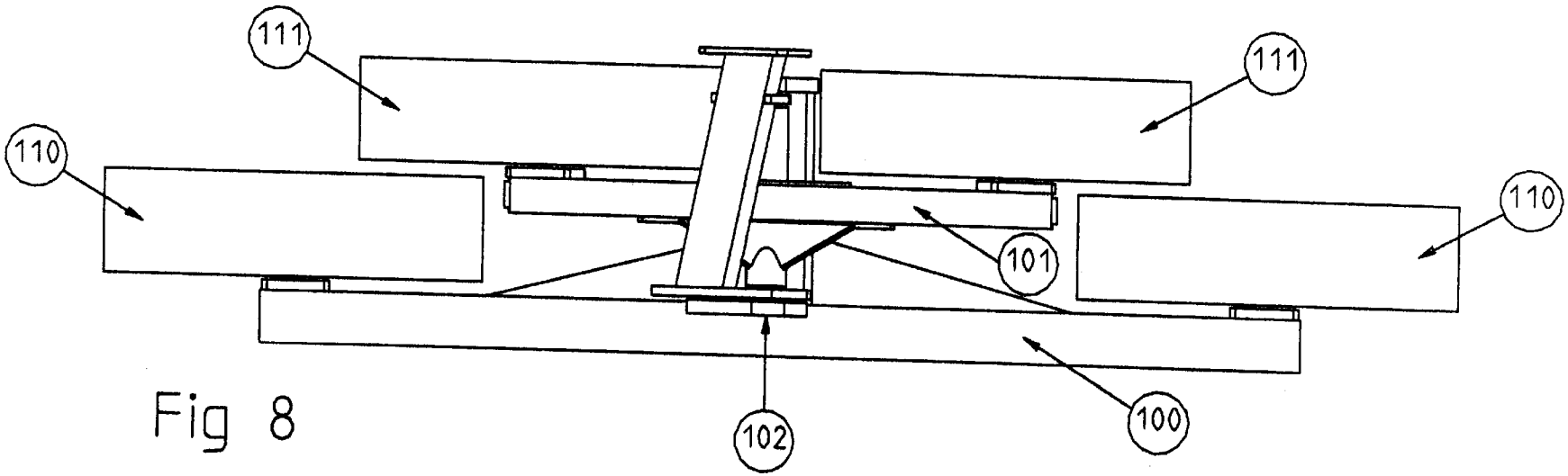

Beam 100 has, adjacent each outer end, a road wheel 110 and beam 101 road wheels 111, the road wheels being mounted for free rotation. The arrangement of the beams is such that the beam 101, which is closest to the bin is shorter than beam 100 and the spacing of wheels 111 is less than the spacing of wheels 110. Inner set of road wheels are spaced by a distance greater than the outer set but the outer set are spaced transversely by a distance greater than the first set. The is such that the outer road wheels 110 partially overlie the inner road wheels 111 and the axial spacing between the two sets of wheels is relatively small, as can be seen from FIG. 8.

Keeping in mind that there are two sets of two beams, one on each side of the unit, when the machine is being moved the two road wheels associated with each beam will tend to reflect changes in the ground surface but as there are the two beams on each side, unless the ground surface is basically similar the movement of the different beams will be different one from the other.

This arrangement gives a totality of movement to the device which is basically relatively even, sudden changes in the surface being compensated for by the movement of the beams and overall, a relatively stable movement is achieved.

With devices of this type in which the wheels are over or adjacent to areas where the ground surface has already been worked and modified or more particularly, one set of wheels tends to be on modified surface and the other on unmodified surface there can be substantial build up of dirt and mud on the wheels.

Because the wheels are free to move one relative to the other and because they are very closely adjacent we can obtain a good self cleaning action of the various wheels.

This can be most desirable in practice.

Figure 2:
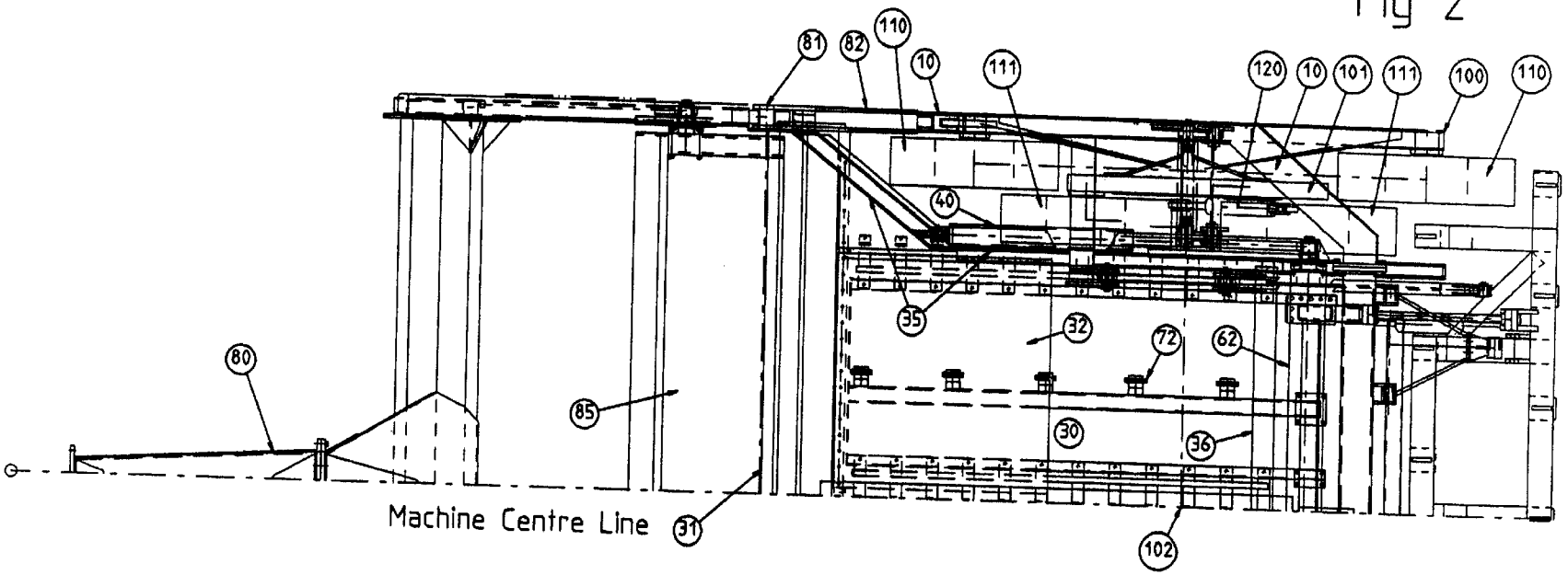
FIG. 2 shows a plan view of the machine, one side of the centerline thereof.
Figure 3:
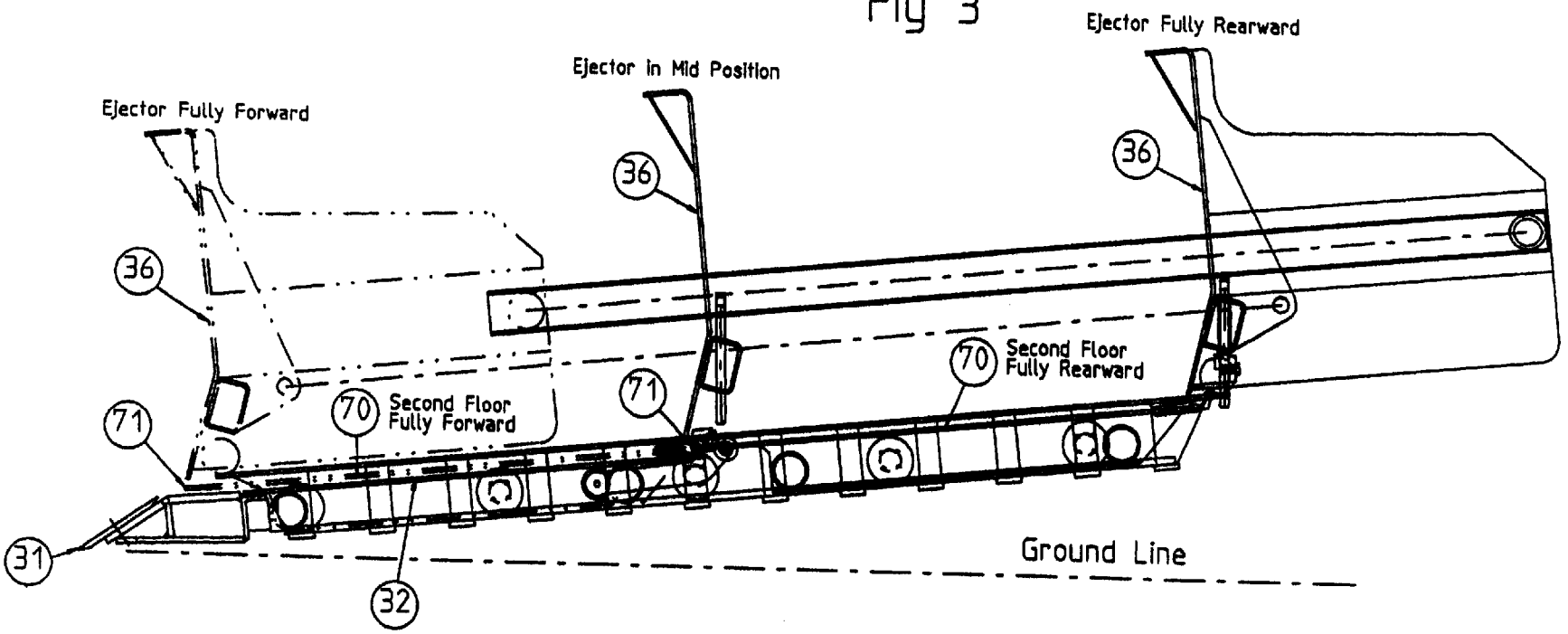
FIG. 3 shows a view similar to that of FIG. 1 sectionalized to indicate the operation of the floor.

Also because of the fact that the wheels on one side of the vehicle may effectively require to be lower or higher than those on the other side, where one is on previously treated surface and the other is untreated surface, or where for some other reason it is required to make a non-uniform cut, I provide on one side means whereby the pivot for the wheels can be raised or lowered relative to the frame. It can be seen in FIG. 2 that I provide a ram 120 which is connected between the frame and the pivot axis of wheel assemble and this can cause the assembly to be moved upwardly or downwardly relative to the frame 10.

That is, the arrangement can be set up so that the body of the device is effectively parallel to the normal ground surface notwithstanding the fact that one set of wheels is below the surface by an amount equivalent to the amount of surface material previously removed.

If required such adjustment could be on both sides but generally this will not be necessary, adjustment of one side is all that is required.

The ripping tines

Tines 91 are used to rip the surface before the material is gathered into the bin. The tines are somewhat different to those which have previously been used in machines of this general types as they are located adjacent the rear of the machine rather than at the front before the bin. As with previous machines they prepare the surface to provide material for later collection as the power needed to both break up the surface and collect the material is more that would be available from the prime mover.

The tines 91 are mounted on a sub-frame 90 which can be rotated about pivot 92 by rams 93 which are connected to the frame of the machine.

Link 94 provides a means whereby the tines can be moved from the ground when the machine is being towed or when it is not necessary to rip the ground surface to provide material to be fed into the bin.

Generally, the movement of the body of the machine about the pivot 81 is not used to adjust the tines but there can be situations where the ground is very hard that it is preferred not to use both sets of tines and the body can be located so that only the forward tines are used to break the ground.

I claim:

1. An earth moving and land grading machine, comprising:

a frame;

road wheels on said frame; and, forwardly directed means for permitting connection to a prime mover, said frame having a bin for material, said bin having a rear wall movable between a first position, wherein said bin is substantially open for receiving the material therein, to a second, forward position during movement for delivering the material from said bin, movement of said rear wall between said first position and said second, forward position being via a hydraulic ram having a piston, said piston having an outer end that moves along a fixed path and is pivotally connected to an arm partway along a length thereof, so that portions of said arm on each side of the pivotable connection have unequal lengths, a first length of said unequal lengths having a longer length is connected to said rear wall and the second length of said unequal lengths having a shorter length is connected to said earth moving and land grading machine, so that upon the movement of said hydraulic ram in a first direction, said rear wall moves rearwardly and upon movement of said hydraulic ram in a second direction, said rear wall moves forwardly, with movement in said first direction and said second direction being by a distance greater than the movement of said piston of said hydraulic ram.

2. The earth moving and land grading machine according to claim 1, wherein said longer length of said arm is connected to said rear wall via a link pivotably connected between an outer end of said arm and said rear wall.

3. The earth moving and land grading machine according to claim 1, wherein said shorter length of said arm is connected to said earth moving and land grading machine via a link pivotably connected between an outer end of said arm and said rear wall.

4. The earth moving and land grading machine according to claim 1, wherein said hydraulic ram is a double-acting ram and the movement of said rear wall in each said direction in effected via operation of said hydraulic ram.

5. The earth moving and land grading machine according to claim 1, further comprising a forwardly extending lip for entering a ground surface and for passing the material into said bin.

6. The earth moving and land grading machine according to claim 5, wherein said rear wall is initially located rearwardly of a front side of said earth moving and land grading machine and the material is able to enter said bin over said forwardly extending lip and is able to fill said earth moving and land grading machine when said bin is to be emptied, said hydraulic ram moving forwardly of said rear wall for delivering material from said bin.

7. The earth moving and land grading machine according to claim 1, wherein said bin has a floor comprises of a first part and a second part, said first part being fixed and covering a forward end of said floor and said second part being movable between a position wherein the second part of said floor is behind said first part of said floor for providing a floor for the entire said earth moving and land grading machine to a position wherein said second part of said floor of said bin substantially overlays the first part of said floor of said bin and terminates close to a front part of said first part.

8. The earth moving and land grading machine according to claim 7, wherein said rear wall is connected with said second part of said floor of said bin, so that when said second part is behind said first part of said floor of said bin, said rear wall is connected thereto, and further including means for releasing the connection of said rear wall when said second part overlies said first part, so that said rear wall is movable forwardly over said second part of said floor of said bin.

9. The earth moving and land grading machine according to claim 7, wherein when said bin is to be filled, said second part of said floor of said bin is located in a forward position with said second part being latched to said first part and said rear wall is at a rearward position of said second part of said floor, when said bin is substantially filled with material, said second part of said floor of said bin is unlatched from said first part and said second part of said floor and said rear wall move rearwardly via said hydraulic ram for exposing said first part of said floor, so that additional material is able to be fed into said bin.

10. The earth moving and land grading machine according to claim 7, further comprising means for reducing resistance on said second part of said floor of said bin when said first part moves over said second part, said means for reducing resistance being located along a length of said first part of said floor of said bin.

11. The earth moving and land grading machine according to claim 10, wherein said means for reducing resistance on said second part of said floor of said bin is rollers extending upwardly from said first part of said floor of said bin.

12. The earth moving and land grading machine according to claim 1, further comprising an apron movable over a front part of said bin after said bin has been filled with the material for maintaining the material therein.

13. The earth moving and land grading machine according to claim 1, wherein said road wheels are on each side of said earth moving and land grading machine and with said each side having a pair of beams pivotably mounted thereon, there being at least two of said road wheels on each beam of said pair of beams, said road wheels of one of said beams being transversely further outward from said frame than other said road wheels, and said road wheels on each said beam being spaced differently in a longitudinal direction so that said road wheels partially overlap one another.

14. The earth moving and land grading machine according to claim 13, wherein said road wheels are arranged so that said beams are free to rotate about their pivots, so that there is substantial compensation for variations in a ground surface over which said earth moving and land grading machine passes.

15. The earth moving and land grading machine according to claim 13, wherein pivots for said beams carrying said road wheels on at least one side of said earth moving and land grading machine are vertically movable relative to said frame so that a transverse orientation of said earth moving and land grading machine, relative to a ground surface, is capable of being varied.

16. The earth moving and land grading machine according to claim 1, further comprising tines located at a rearward part of said earth moving and land grading machine, said tines being movable from a first position at which said tines are spaced from a ground surface to a second position at which said tines enter the ground surface for breaking up the ground surface for providing the material to be received in said bin.

17. An earth moving and land grading machine, comprising:

a frame;

road wheels on each side of said frame, with each said side of said frame having a pair of transversely spaced beams, each said beam being individually mounted for pivotal movement relative to said frame, with at least two of said road wheels on each said beam, said road wheels mounted on one said beam are positioned transversely outwardly from said frame relative to said road wheels mounted upon another of said beams, said road wheels on each said beam being spaced differently in a longitudinal direction so that said road wheels partially overlap with inner surfaces of adjacent said road wheels, said inner surfaces of said adjacent said road wheels being sufficiently closely adjacent so that a build-up of soil on said road wheels is restricted due to the closely adjacent positioning between overlapping portions of said road wheels.

18. The earth moving and land grading machine according to claim 17, wherein said road wheels are arranged so that said beams are free to rotate about their pivots, so that there is substantial compensation for variations in a ground surface over which said earth moving and land grading machine passes.

19. The earth moving and land grading machine according to claim 17, wherein pivots for said beams carrying said road wheels on at least one side of said earth moving and land grading machine are vertically movable relative to said frame so that a transverse orientation of said earth moving and land grading machine, relative to a ground surface, is capable of being varied.

20. A method for filling and emptying an earth moving and land grading machine having a soil-receiving bin with two floor parts, a first of said floor parts being a rear floor part for moving over a second of said floor parts being a forward floor part, said earth moving and land grading machine further including a movable wall wherein, when said soil-receiving bin is to be filled, said rear floor part is located over said forward floor part and said wall is rearward of said rear floor part, said method comprising the steps of:

moving in a forward direction said earth moving and land grading machine until an exposed volume of said soil-receiving bin is filled with soil;

moving rearwardly said rear floor part and said wall so that the soil is moved to a rearward portion of said earth moving and land grading machine; and, continuing to moving in said earth moving and land grading machine in the forward direction until said soil-receiving bin is substantially fully loaded.

21. The method for filling and emptying an earth moving and land grading machine according to claim 20, further comprising the steps of:

moving forwardly said rear floor part and said wall so that the soil is removed from said earth moving and land grading machine;

moving said rear floor part to a position where said rear floor part overlays said forward floor part;

holding in said position said rear floor part relative to said forward floor part; and, moving forwardly said wall to remove any remaining soil from said soil-receiving bin.

22. The method for filling and emptying an earth moving and land grading machine according to claim 20, further comprising the step of:

placing an apron over said soil-receiving bin once said soil-receiving bin is substantially fully loaded.

* * * * *